US007060881B2

(12) United States Patent
Sakai

(10) Patent No.: US 7,060,881 B2
(45) Date of Patent: Jun. 13, 2006

(54) METHODS FOR MANUFACTURING FRETS FOR STRINGED INSTRUMENTS

(76) Inventor: Hiromi Sakai, 1-8-32, Honfujisawa, Fujisawa, Kanagawa 251-0875 (JP)

( * ) Notice: Subject to any disclaimer, the term of this patent is extended or adjusted under 35 U.S.C. 154(b) by 44 days.

(21) Appl. No.: 10/862,333

(22) Filed: Jun. 8, 2004

(65) Prior Publication Data

US 2005/0268770 A1 Dec. 8, 2005

(51) Int. Cl.
*G10D 3/00* (2006.01)

(52) U.S. Cl. ..... 84/314 R; 84/267

(58) Field of Classification Search ..... 84/314 R, 84/267; 984/346
See application file for complete search history.

(56) References Cited

U.S. PATENT DOCUMENTS 6,613,969 B1 * 9/2003 Petillo et al. ..... 84/314 R
2001/0029827 A1 * 10/2001 Chapman ..... 84/314 R

* cited by examiner

*Primary Examiner*—David Martin
*Assistant Examiner*—Jianchun Qin
(74) *Attorney, Agent, or Firm*—Wenderoth, Lind & Ponack, L.L.P.

(57) ABSTRACT

Frets can be provided for stringed instruments without requiring a process for scraping both ends of a fret main body after the frets are installed into a fingerboard of a stringed instrument. Both ends of the fret main body are formed in a shape along a cross-sectional shape of the fingerboard at both sides of the fingerboard when the frets are driven into fret grooves of a fingerboard. Each of the frets is provided with a fret main body for dividing a surface of the fingerboard and a leg portion standing unitedly on an underside of the fret main body.

2 Claims, 6 Drawing Sheets

METHODS FOR MANUFACTURING FRETS FOR STRINGED INSTRUMENTS

BACKGROUND OF THE INVENTION

This invention relates to frets for stringed instruments such as acoustic guitars etc. and a method for manufacturing the frets.

A plurality of frets each of which consists of a slender metal piece are provided in specific intervals in a direction in which strings are stretched on a fingerboard at a stringed instrument such as a guitar, etc., so that a halftone is changed every one fret by means of moving a position of a string supported by the fret.

The fret has a shape as shown in FIG. 9 of JP 2002-41029 A, and as shown in FIG. 10 of this application as prior art. This fret 1 is provided with a fret main body 2 whose cross-sectional view is a slender arc shape, and a leg portion 3 which is formed unitedly overall in the middle of an underside of the fret main body 2. Both ends of the fret main body 2 are cut perpendicularly to a length direction thereof and both ends of the leg portion 3 are cut perpendicularly to the length direction at positions inwardly from the ends of the fret main body. The frets are delivered from companies manufacturing frets as they are.

The fret 1 is, as shown in FIG. 11, installed into a fret insertion groove 18 formed on the fingerboard 17 unitedly attached on an upper surface of a neck 16 by pressing. In this case, both ends of the fret project from the fingerboard 17, so that the fret cannot be used because the ends would stick a finger. Therefore, the projecting portions of the ends are scraped by a buff until they attain a cross-sectional shape shown by dotted lines in FIG. 11.

Thus, a process such as scraping the end portions projecting from the fingerboard after the frets are installed on the fingerboard has remained. The scraping process was effective until an error for attaching the frets into the fingerboard (an error in a width direction) occurred, but it became useless recently since the frets are currently installed into the fret insertion grooves with precision.

SUMMARY OF THE INVENTION

An object of the invention is to do away with a process for scraping both ends of a fret main body of a fret used in stringed instruments to simplify the production process.

Accordingly, this invention is directed to frets for stringed instruments driven into fret grooves of a fingerboard. Each of the frets is provided with a fret main body for dividing a surface of the fingerboard, and a leg portion standing unitedly on an underside of the fret main body, wherein both ends of the fret main body are formed in a shape on both sides of the fingerboard along a cross-sectional shape of the fingerboard.

It is preferred that the shape includes an inclination at a specific angle at each end of the fret main body.

Thus, since both ends of the fret main body are formed beforehand in the same shape as the cross-sectional shape of the fingerboard, namely with an inclination shape, it becomes necessary only to attach the fret in a fingerboard, and, as a result, the process for scraping the ends of the fret after the installation can be omitted.

Furthermore, the shape is preferably constituted of a stand-up portion standing from a lower part of each end of the fret main body and an inclination at a specific angle continuing from the stand-up portion.

Accordingly, a small area which can be modified may remain in both ends of the fret.

A method for manufacturing frets for stringed instruments according to the invention preferably includes fixing a continuous fret line provided with a fret main body at an upper thereof and a leg portion at a lower portion thereof; cutting and separating a fret with a specific length from the continuous fret line by moving an end mill having an inclination scraping portion and a plane scraping portion from one side thereof in a direction perpendicular to the continuous fret line, while forming the inclination at an end of the fret main body of the cut-off fret and an end of the continuous fret line and forming cut-out portions spaced at a specific dimension in the end of the leg portion of the cut-off fret and the end of the leg portion of the continuous fret line, respectively.

Thus, by only moving one end mill perpendicularly, a process for forming the inclinations and the cut-out portions at both ends of the fret main body can be carried out simultaneously to cut off the fret.

Moreover, a method for manufacturing frets for stringed instruments according to the invention, preferably includes fixing a continuous fret line provided with a fret main body at an upper portion thereof and a leg portion at a lower portion thereof; punching out the leg portion by moving a punch perpendicularly to the continuous fret line from one side thereof to form a cut-out portion in the leg portion; and dropping down a punch from an upper side of the cut-out portion and cutting off the fret line to form the fret while inclinations at a specific angle are formed on an end of the cut-off fret and an end of the fret line, respectively.

Accordingly, the cut-out portion is formed at the leg portion by one punch, and then forming the inclination and cutting at the same time can be achieved by another punch.

DETAILED EXPLANATION OF THE INVENTION

Figure 1:
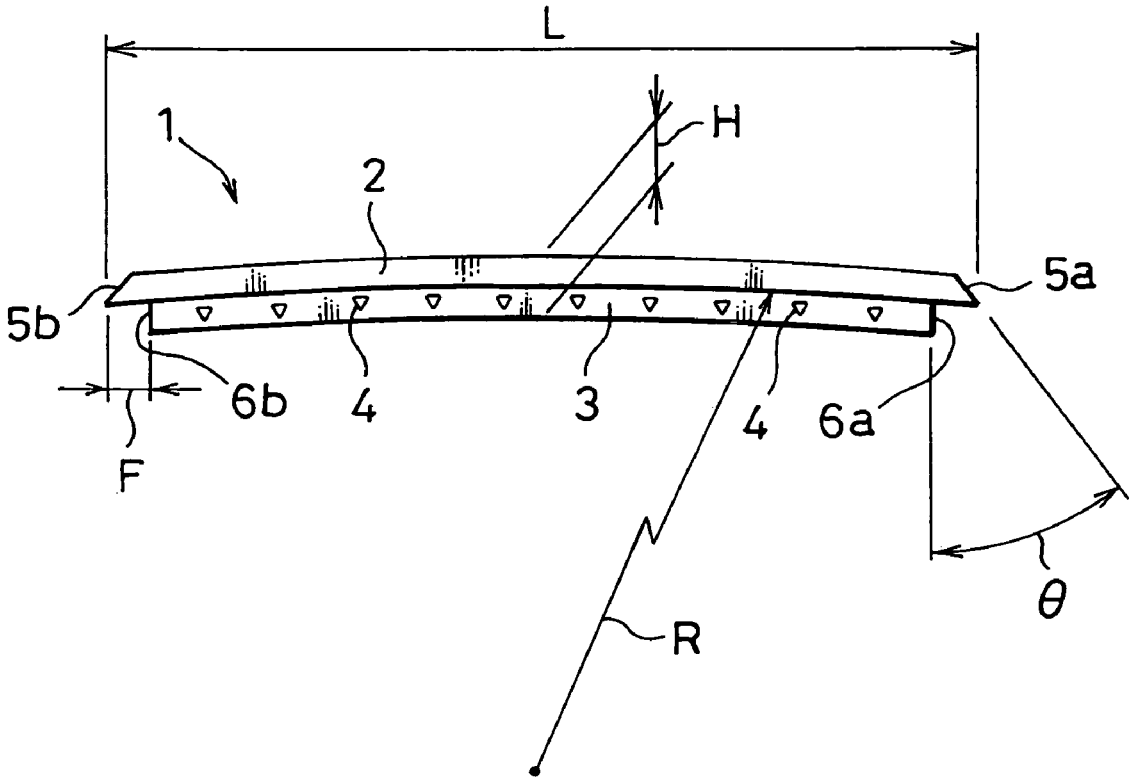
FIG. 1 is a front view of a fret according to a first working mode of the invention.
Figure 2:
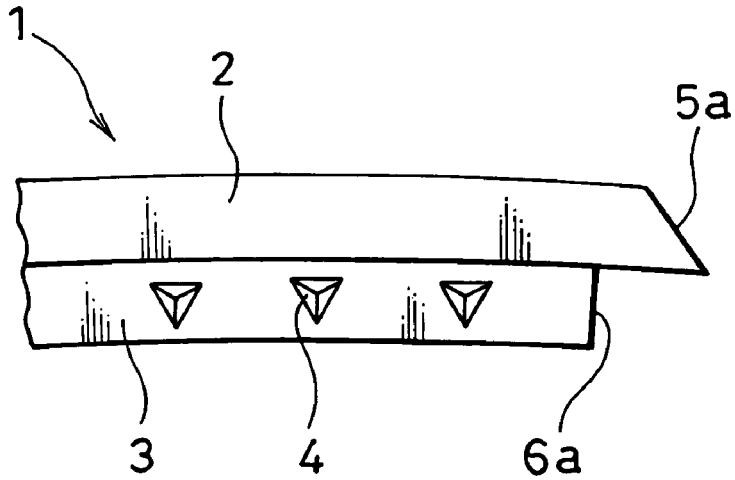
FIG. 2 is a partial enlarged diagram of an end of the fret according to the first working mode of the invention.

Hereinafter, working modes of the invention are explained with reference to the drawings. FIG. 1 is a front view of a fret 1 according to the invention and FIG. 2 is a partial enlarged diagram of an end of the fret 1. The fret 1 is provided with a fret main body 2 whose cross-sectional view is a slender arc shape, and a leg portion 3 which is formed unitedly overall in the middle of an underside of the fret main body 2, wherein a plurality of wedges 4 are formed along a length direction on the leg portion 3.

Both ends of the fret main body 2 of the fret 1 have inclinations 5*a*, 5*b*, respectively. An angle θ of the inclinations 5*a*, 5*b* is formed within a range of approximately 20° to 60° with respect to a line perpendicular to a length direction of the fret 1. Concretely, the angle θ is equal to a cross sectional shape of both side surfaces of the fingerboard on which the frets 1 are installed.

Cut-out portions 6*a*, 6*b* are formed on both sides of the leg portion 3 of the fret 1, respectively. The cut-off portions 6*a*, 6*b* are cut off perpendicularly to the length direction of the fret 1 at positions inward from both ends thereof. Incidentally, a length L of the fret 1 is approximately 30 mm–100 mm, the same as a width dimension of the fingerboard of a stringed instrument. A height H of the fret 1 is approximately 2.50 mm–4.00 mm, the cut-off portion F is approximately 2.00 mm–3.00 mm, and a curvature radius R is approximately 180 mm –400 mm. Thus, a variety of condition such as the length, etc., arise from differences not only in the kinds of musical instruments but also the positions of the frets.

Figure 3:
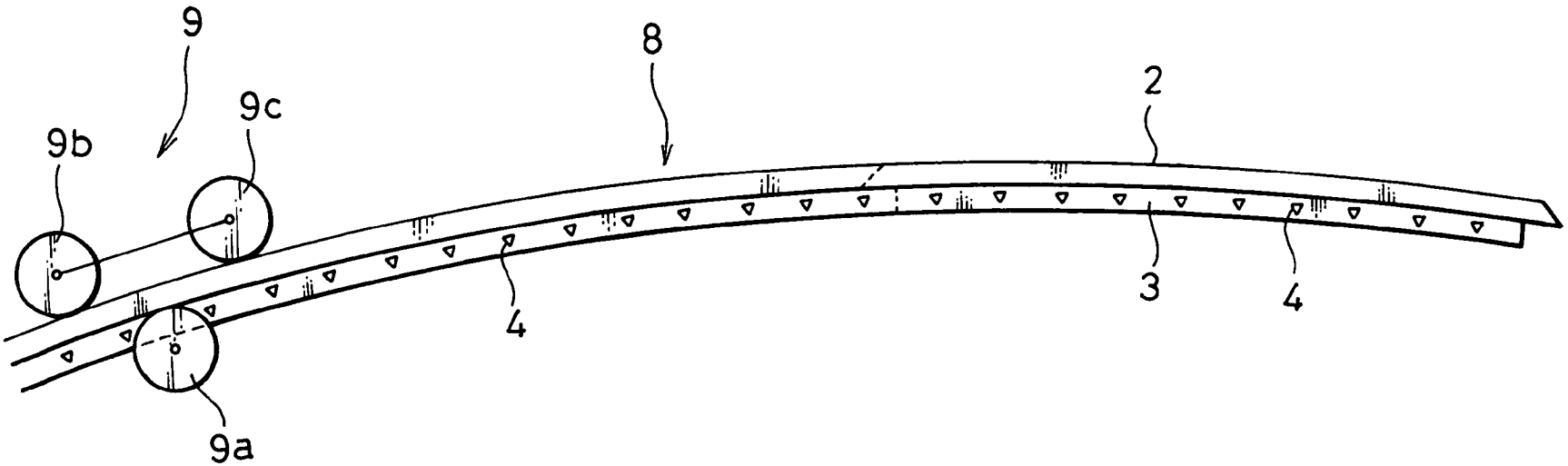
FIG. 3 is an illustration showing a condition before a fret is cut-off from a fret line.

Hereinafter, a method for manufacturing frets 1 including the above structure is explained. As shown in FIG. 3, a long fret line 8 in which a fret main body 2, whose cross section is a half circle, is formed on an upper side thereof and a leg portion 3, whose cross section is square, is formed on an underside thereof by processing steel. The long fret line 8 is transferred from a device not shown in the figures. The long fret line 8 is curved by a processing device 9 including three rollers 9*a*, 9*b*, 9*c*, before being cut off at a specific length. A cutting position of the fret 1 is shown as a dotted line.

Figure 4:
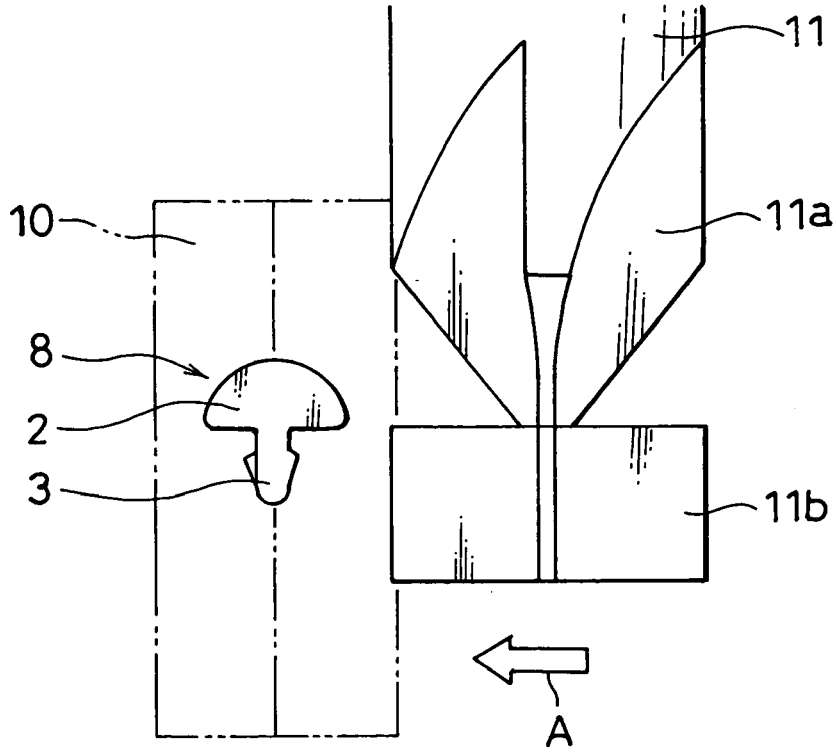
FIG. 4 is an illustration showing a first method for manufacturing frets from a side direction.
Figure 5:
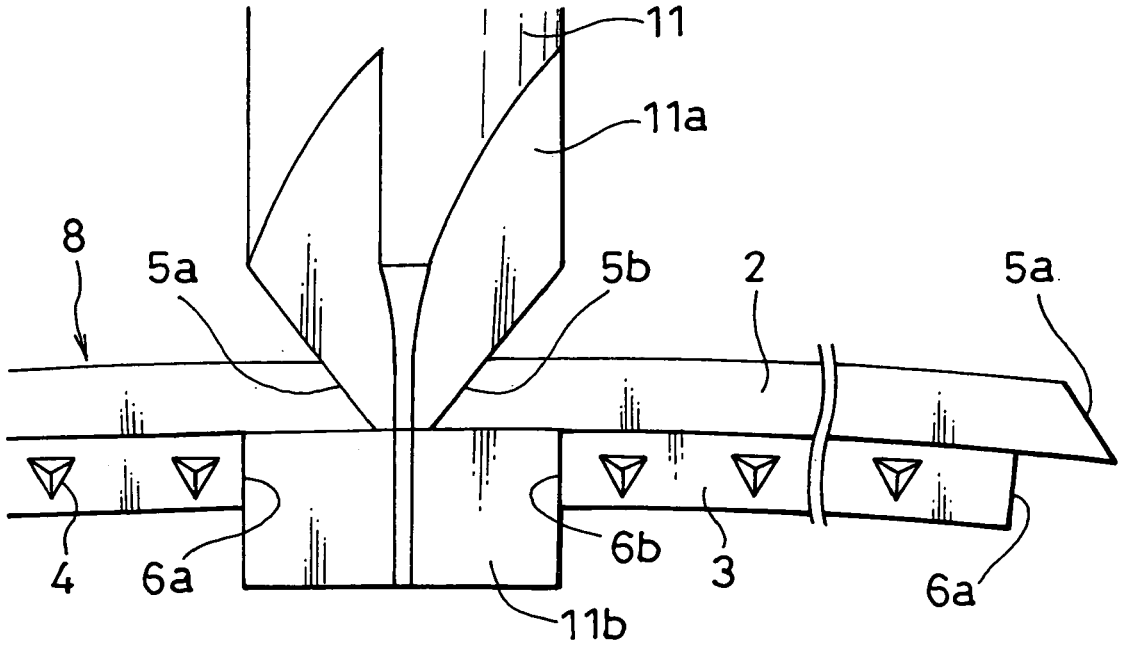
FIG. 5 is an illustration showing the first method for manufacturing frets from a front direction.

FIGS. 4 and 5 illustrate a first method for manufacturing. The fret line 8 transferred from equipment not shown in the figures is gripped by a fret line gripper 10. Then, an end mill 11 having an inclination scraping unit 11*a* and a plane scraping unit 11*b* is moved in a direction as shown by an arrow A in FIG. 4 (a perpendicular direction). Then, the fret 1 is formed by cutting off an end portion of the fret line 8 at a specific length, while the inclination 5*a* at an end portion of the fret main body 2 of the fret line 8 and the inclination 5*b* at an end portion of the cut-off fret 1 are formed by the inclination scraping unit 11*a* at the same time, and the cut-out portion 6*a* at an end of the leg portion 3 of the fret line 8 and the cut-out portion 6*b* at an end of the cut-off fret 1 are formed by the plane scraping unit 11*b* at the same time.

Figure 6:
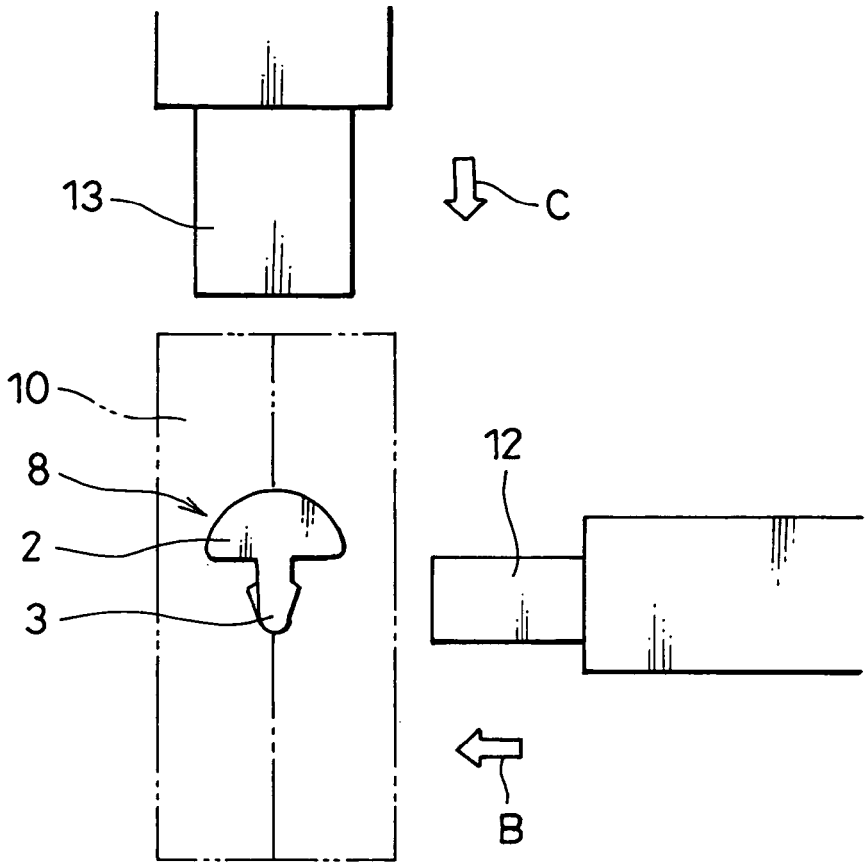
FIG. 6 is an illustration showing a second method for manufacturing frets from a side direction.
Figure 7:
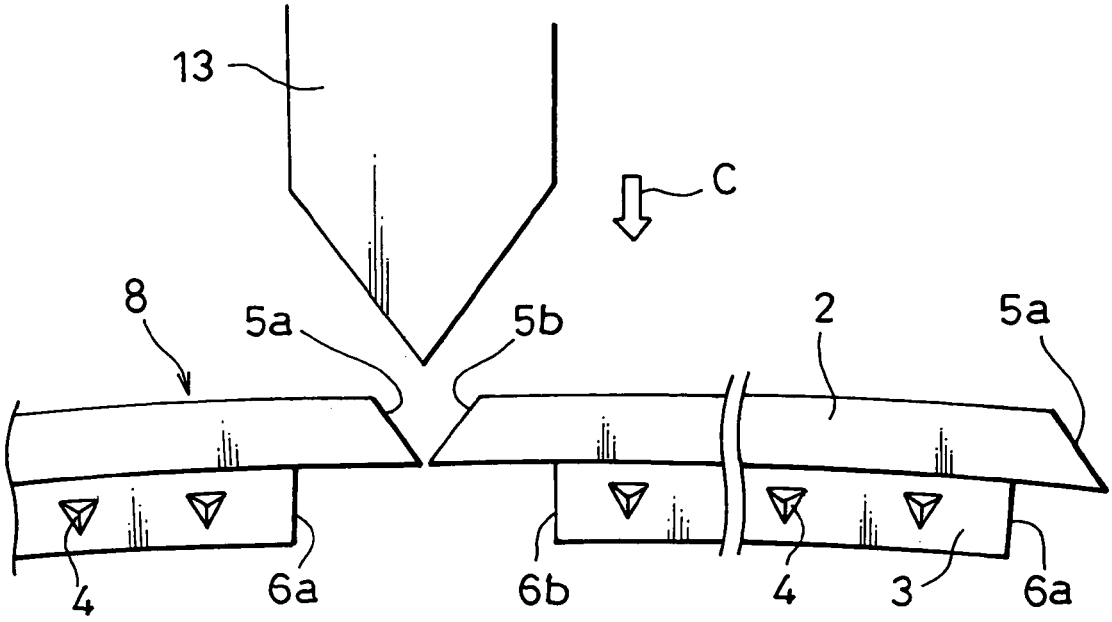
FIG. 7 is an illustration showing the second method for manufacturing frets from a front direction.

FIGS. 6 and 7 illustrate a second method for manufacturing. The fret line 8 transferred from equipment not shown in the figures is gripped by a fret line gripper 10. Then, a punch 12 is moved to the leg portion 3 of the fret line 8 in a direction as shown by an arrow B (a perpendicular direction) to form cut-out portions 6*a*, 6*b* at the leg portion 3 of the fret line 8. And then, a punch 13 is dropped down in a direction as shown by an arrow C to form the fret 1 by cutting off, while the inclination 5*a* at the end of the fret main body 2 of the fret line 8 and the inclination 5*b* at an end of the cut-off fret 1 are formed at the same time.

Figure 8:
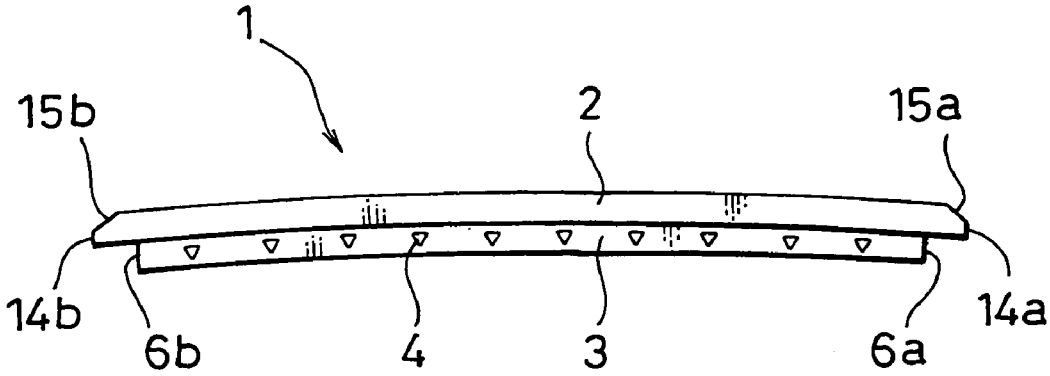
FIG. 8 is a front view of a fret according to a second working mode of the invention.
Figure 9:
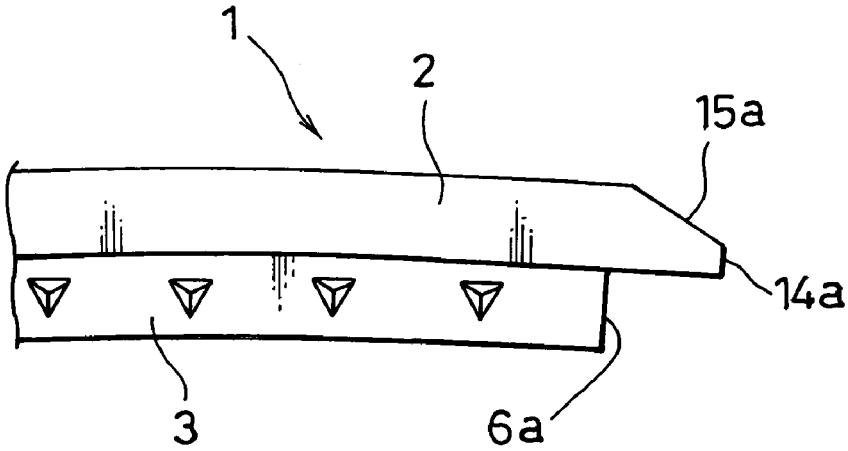
FIG. 9 is a partial enlarged diagram of an end of the fret according to the second working mode of the invention.
Figure 10:
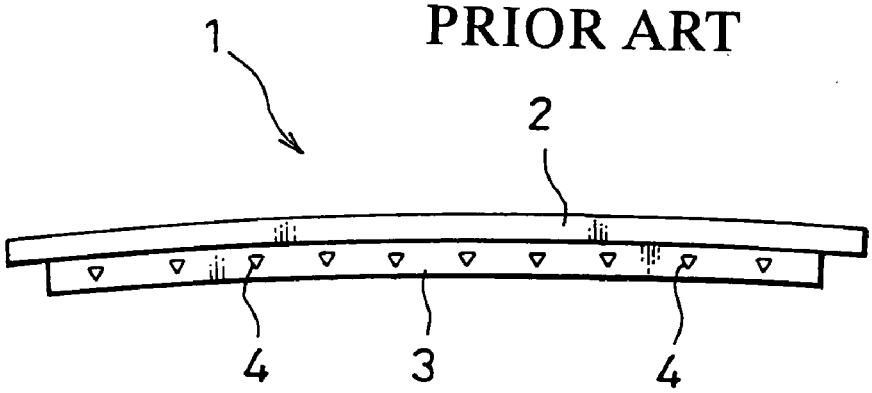
FIG. 10 PRIOR ART
FIG. 10 is a front view of a prior art fret.
Figure 11:
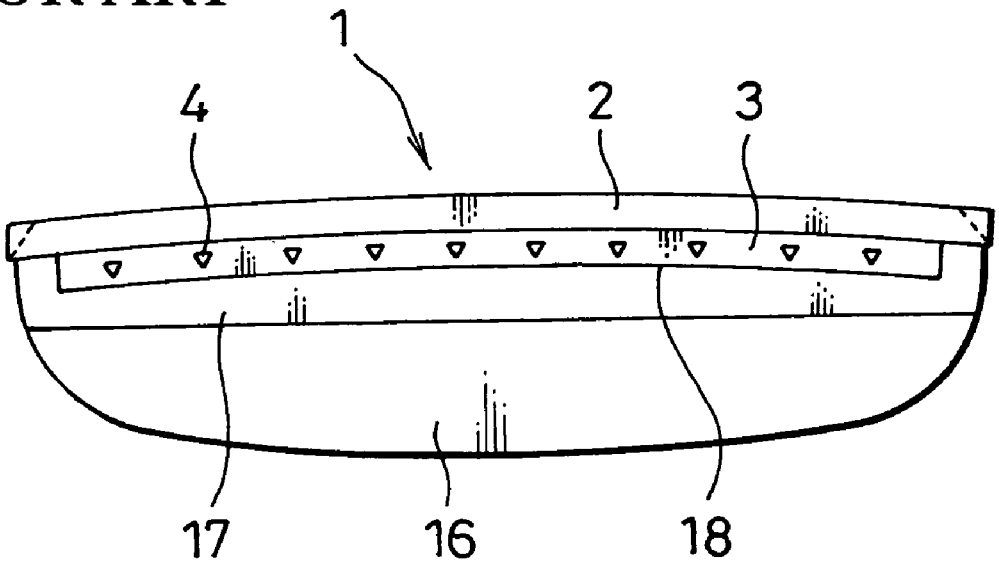
FIG. 11 PRIOR ART
FIG. 11 is an illustration showing the prior art fret driven in a finger board.

FIGS. 8 and 9 show another working mode of the invention. A fret 1 according to this embodiment is different from the fret of the first working mode in that shapes of both ends of the fret main body 2 of the fret 1 are constituted by stand-up portions 14*a*, 14*b* and inclinations 15*a*, 15*b* continuous with the stand-up portions 14*a*, 14*b* and are similar to cross sectional shapes of both side surfaces of the fingerboard, respectively. Accordingly, the frets can be modified by processing the ends thereof after the frets are installed into the fingerboard, so that an effect such as to prevent inferior goods can be gained.

As explained above, in the working mode illustrated in FIGS. 1 and 2, since each end of the fret main body has a shape such as to meet to a shape of the fingerboard, that is to say, an inclination, there is an advantage such that processing after driving the frets into the fingerboard can be omitted.

In addition, in the working mode illustrated in FIGS. 8 and 9, spaces which can be modified remain at the both ends of the fret main body.

Both of the methods for manufacturing frets are simple manufacturing processes. Namely, the frets can be manufactured by one tool and one movement in the first method for manufacturing, and the frets can be manufactured by two tools and simple movement in the second method for manufacturing.

What is claimed is:

1. A method for manufacturing frets to be driven into fingerboards of stringed instruments, each of said frets including a fret main body for dividing a surface of the fingerboard and a leg portion standing unitedly on an underside of said fret main body, wherein said fret main body has two ends, each formed in a shape constituted of an inclination at a specific angle, to be provided at both sides of the fingerboard along a cross-sectional shape of the fingerboard, said method comprising:

fixing a continuous fret line having a fret main body at an upper portion thereof and a leg portion at a lower portion thereof; and cutting and separating a fret with a specific length from said continuous fret line by moving an end mill having an inclination scraping portion and a plane scraping portion from one side thereof in a direction perpendicular to said continuous fret line, while forming said inclination at an end of said fret main body of said cut-off fret and an end of said continuous fret line and forming cut-out portions spaced at a specific dimension in said end of said leg portion of said cut-off fret and said end of said leg portion of said continuous fret line, respectively.

2. A method for manufacturing frets to be driven into fingerboards of stringed instruments, each of said frets including a fret main body for dividing a surface of the fingerboard and a leg portion standing unitedly on an underside of said fret main body, wherein said fret main body has two ends, each formed in a shape constituted of an inclination at a specific angle, to be provided at both sides of the fingerboard along a cross-sectional shape of the fingerboard, said method comprising:

fixing a continuous fret line having a fret main body at an upper portion thereof and a leg portion at a lower portion thereof;

punching out said leg portion by moving a punch perpendicularly to said continuous fret line from one side thereof to form a cut-out portion in said leg portion; and dropping down a punch from an upper side of said cut-out portion and cutting off said fret line to form cut-off fret while inclinations at a specific angle are formed on an end of said cut-off fret and an end of the fret line, respectively.

* * * * *